US007393077B2

(12) United States Patent
Kusakari

(10) Patent No.: US 7,393,077 B2
(45) Date of Patent: Jul. 1, 2008

(54) INKJET RECORDING APPARATUS

(75) Inventor: Tsutomu Kusakari, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 485 days.

(21) Appl. No.: 11/092,785

(22) Filed: Mar. 30, 2005

(65) Prior Publication Data

US 2005/0219291 A1 Oct. 6, 2005

(30) Foreign Application Priority Data

Mar. 31, 2004 (JP) ..... 2004-107671

(51) Int. Cl.
*B41J 29/393* (2006.01)

(52) U.S. Cl. ..... 347/19

(58) Field of Classification Search ..... 347/13, 347/19, 42, 105
See application file for complete search history.

(56) References Cited

U.S. PATENT DOCUMENTS 5,903,288 A 5/1999 Yamaguchi

FOREIGN PATENT DOCUMENTS

JP 63-260448 A 10/1988
JP 5-338199 A 12/1993
JP 6-340063 A 12/1994
JP 9-24627 A 1/1997
JP 9-216388 A 8/1997
JP 10-6488 A 1/1998
JP 10-44467 A 2/1998
JP 2001-310478 A 11/2001
JP 2003-63043 A 3/2003
JP 2003-94615 A 4/2003

*Primary Examiner*—Lamson Nguyen
(74) *Attorney, Agent, or Firm*—Birch, Stewart, Kolasch & Birch, LLP

(57) ABSTRACT

The inkjet recording apparatus comprises: a full line print head in which a plurality of nozzles are arranged for respective ink colors across a length corresponding to a full width of a recording medium; a selection device which selects at least one of the plurality of nozzles for printing a dot onto the recording medium as a dot for a discharge failure detection, from at least one of the plurality of nozzles to be used for a print for obtaining a final output image based on print data; a discharge failure detection device which performs the discharge failure detection by reading in the dot for the discharge failure detection printed on the recording medium; and a reverse conveyance device which returns the recording medium to a printing position of the print head after the discharge failure detection performed by the discharge failure detection device, wherein the print for obtaining the final output image is performed by the print head onto the recording medium, by returning the recording medium to the printing position of the print head by the reverse conveyance device after the discharge failure detection performed by the discharge failure detection device.

10 Claims, 14 Drawing Sheets

INKJET RECORDING APPARATUS

BACKGROUND OF THE INVENTION

1. Field of the Invention

The present invention relates to an inkjet recording apparatus, and more particularly, to technology for repairing recording errors caused by ink discharge failures during image recording in an inkjet recording apparatus.

2. Description of the Related Art

An inkjet type image forming apparatus has an inkjet head (print head) in which a plurality of nozzles are arranged, and it forms images on a recording medium by discharging ink from the nozzles while moving the print head and the recording medium relatively with respect to each other.

In an inkjet recording apparatus of this kind, blocking of the nozzles of the print head or soiling of the ink meniscus may give rise to printing errors in which ink fails to be discharged or ink is not discharged in the correct direction of flight, thus leading to omissions in the print. Printing omissions of this kind are not readily noticeable in the case of a shuttle scan system, since there is a large degree of overlap in the print, but in the case of a line head, printing omissions are highly noticeable.

Therefore, various methods for detecting print omissions caused by discharge failure of this kind and methods for rectifying print omissions when they are detected, have been proposed.

In one known example, it is determined whether or not ink particles have been discharged correctly by comparing the printed dots with the print data, by means of an image sensor (see, for example, Japanese Patent Application Publication No. 63-260448).

In a further known example, a test pattern is recorded onto a recording medium, this test pattern is read out by a discharge failure detection device, and if it is determined that an ink discharge failure has occurred in a portion of the plurality of discharge ports, then the supply of drive data for discharging ink from the discharge ports is changed by means of discharge ports other than a discharge port which has produced a discharge failure. Thereby, even if a discharge failure has occurred in a portion of the discharge ports of the recording head, it is still possible to assign this drive data to other discharge ports which are functioning normally. Therefore, recording can even be performed by a recording head in which a portion of the nozzles have produced discharge failures (see, for example, Japanese Patent Application Publication No. 5-338199).

In a further known example, the image recording status recorded onto a special test recording member is read in by a reading device, and the driving the recording device is controlled on the basis of the image information thus read out. Furthermore, the image recorded onto the test recording member is erased so that the member can be reused (see, for example, Japanese Patent Application Publication No. 6-340063).

In yet a further known example, it is judged, on the basis of bit map data for a black ink recording head, whether or not there is a region where dots are to be formed by black ink in a line corresponding to those nozzle openings in a color (other than black) recording head that are required to perform at least dummy discharge. When the nozzle openings of the color ink recording head which are required to perform dummy discharge are positioned facing the positions at which dots of black ink are to be formed, the nozzle openings of the color ink recording head required to perform dummy discharge are caused to discharge ink droplets of one color onto one point, separately from the print data. Dots of black ink based on the print data are subsequently printed and superimposed onto the color dots formed by the dummy discharges, thereby concealing the color dots of the dummy discharges. Therefore, it is possible to avoid nozzle blockages by performing dummy discharges during printing, without having to interrupt the printing operation (see, for example, Japanese Patent Application Publication No. 9-216388).

However, in Japanese Patent Application Publication No. 63-260448, in the case of a single-pass system which does not involve overwriting, or a system using high-density nozzles or a high number of nozzles, the adjacently positioned dots overlap closely with each other, and therefore it is not possible to detect discharge failures accurately by detecting the dots.

Furthermore, in Japanese Patent Application Publication No. 5-338199, discharge failures are detected by recording a test pattern onto a recording medium, and therefore wasted recording medium is generated. In Japanese Patent Application Publication No. 6-340063, a special, separate recording medium for determination is required, and although this medium can be reused, a special cleaning device for the recording medium is also required in order that it can be reused. Therefore, the composition of the device becomes complicated.

In Japanese Patent Application Publication No. 9-216388, nozzle blockages are prevented by performing a dummy discharge during printing, but discharge failures are not detected and therefore countermeasures cannot be adopted during printing if a discharge failure has occurred. The printing operation must be interrupted in order to perform a restoring operation with respect to the nozzles.

SUMMARY OF THE INVENTION

The present invention has been contrived with these circumstances in view, and an object thereof is to provide an inkjet recording apparatus which can accurately detect discharge failures without requiring a special recording member for determination purposes, and which can produce a rectified image in cases where a discharge failure has occurred, without wasting the recording medium.

In order to attain the aforementioned object, the present invention is directed to an inkjet recording apparatus, comprising: a full line print head in which a plurality of nozzles are arranged for respective ink colors across a length corresponding to a full width of a recording medium; a selection device which selects at least one of the plurality of nozzles for printing a dot onto the recording medium as a dot for a discharge failure detection, from at least one of the plurality of nozzles to be used for a print for obtaining a final output image based on print data; a discharge failure detection device which performs the discharge failure detection by reading in the dot for the discharge failure detection printed on the recording medium; and a reverse conveyance device which returns the recording medium to a printing position of the print head after the discharge failure detection performed by the discharge failure detection device, wherein the print for obtaining the final output image is performed by the print head onto the recording medium, by returning the recording medium to the printing position of the print head by the reverse conveyance device after the discharge failure detection performed by the discharge failure detection device.

According to the present invention, no recording medium for test printing in order to detect discharge failures is necessary, discharge failure detection can be performed without wasting the recording medium, and reduction in through-put can be prevented.

Preferably, an interval between dots for the discharge failure detection on the recording medium is not less than one half of a minimum diameter of dot printed by the print head. Thereby, it is possible to improve determination accuracy of the dots for discharge failure detection.

Preferably, the selection device selects the dot for the discharge failure detection from a region of low visibility of the final output image.

Preferably, the selection device selects the dot for the discharge failure detection from one of a front end section and a trailing end section of the final output image on the recording medium.

According to the present invention, even if there is positional displacement of the recording medium when it is returns to the printing position of the print head and printing is carried out in order to obtain the final output image, this displacement will not be readily visible.

Preferably, the selection device selects the at least one of the plurality of nozzles for printing the dot for the discharge failure detection onto the recording medium, according to history data for each of the plurality of nozzles. Thereby, it is possible to reduce the amount of ink consumed by determining discharge from nozzles where a danger of discharge failure is predicted.

Preferably, when the selection device selects at least two of the plurality of nozzles for printing dots for the discharge failure detection onto the recording medium, the selection device specifies one of the dots for the discharge failure detection as a reference dot for positioning; the inkjet recording apparatus further comprises a reference positioning sensor which detects the reference dot, the reference positioning sensor being arranged in a vicinity of the print head; and the print for obtaining the final output image is performed by taking a position of the reference dot detected by the reference positioning sensor as a reference position.

According to the resent invention, it is possible to prevent printing errors when printing the final output image after the discharge failure detection.

In order to attain the aforementioned object, the present invention is also directed to an inkjet recording apparatus comprising: a full line print head in which a plurality of nozzles are arranged for respective ink colors across a length corresponding to a full width of a recording medium; a selection device which selects at least one of the plurality of nozzles for printing a dot onto the recording medium for a discharge failure detection, from at least one of the plurality of nozzles to be not used for a print for obtaining a final output image based on print data; a discharge failure detection device which performs the discharge failure detection by reading in the dot for the discharge failure detection printed on the recording medium; and a reverse conveyance device which returns the recording medium to a printing position of the print head after the discharge failure detection performed by the discharge failure detection device, wherein the dot for the discharge failure detection is printed outside a region of the final output image, and the print for obtaining the final output image is performed by the print head onto the recording medium, by returning the recording medium to the printing position of the print head by the reverse conveyance device after the discharge failure detection performed by the discharge failure detection device.

According to the resent invention, it is possible to detect discharge failures without affecting the final output image.

Preferably, if a discharge failure is detected by the discharge failure detection device, then a compensation operation is performed with respect to the dot subject to the discharge failure, by means of adjacent nozzles to the nozzle for which the discharge failure has been detected. Thereby, it is possible to rectify an image containing discharge failure, without wasting the recording medium.

As described above, according to the inkjet recording apparatus according to the present invention, discharge failures can be detected accurately without requiring a special recording member for determination purposes, and a rectified image can be produced in cases where a discharge failure has occurred, without wasting the recording medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 15 is an illustrative diagram showing a situation where a nozzle suffering a discharge failure is compensated for.

DETAILED DESCRIPTION OF THE PREFERRED EMBODIMENTS

In the present embodiment, dots (namely, the nozzles discharging those dots) to be used for discharge failure detection are selected from the output print data to be recorded, and these dots are printed onto the recording medium and determined by means of a light source and reading sensor. After the determination, the recording medium is returned to its recording position, and a final output image is obtained by ejecting additional droplets in accordance with the remaining print data.

Figure 1:
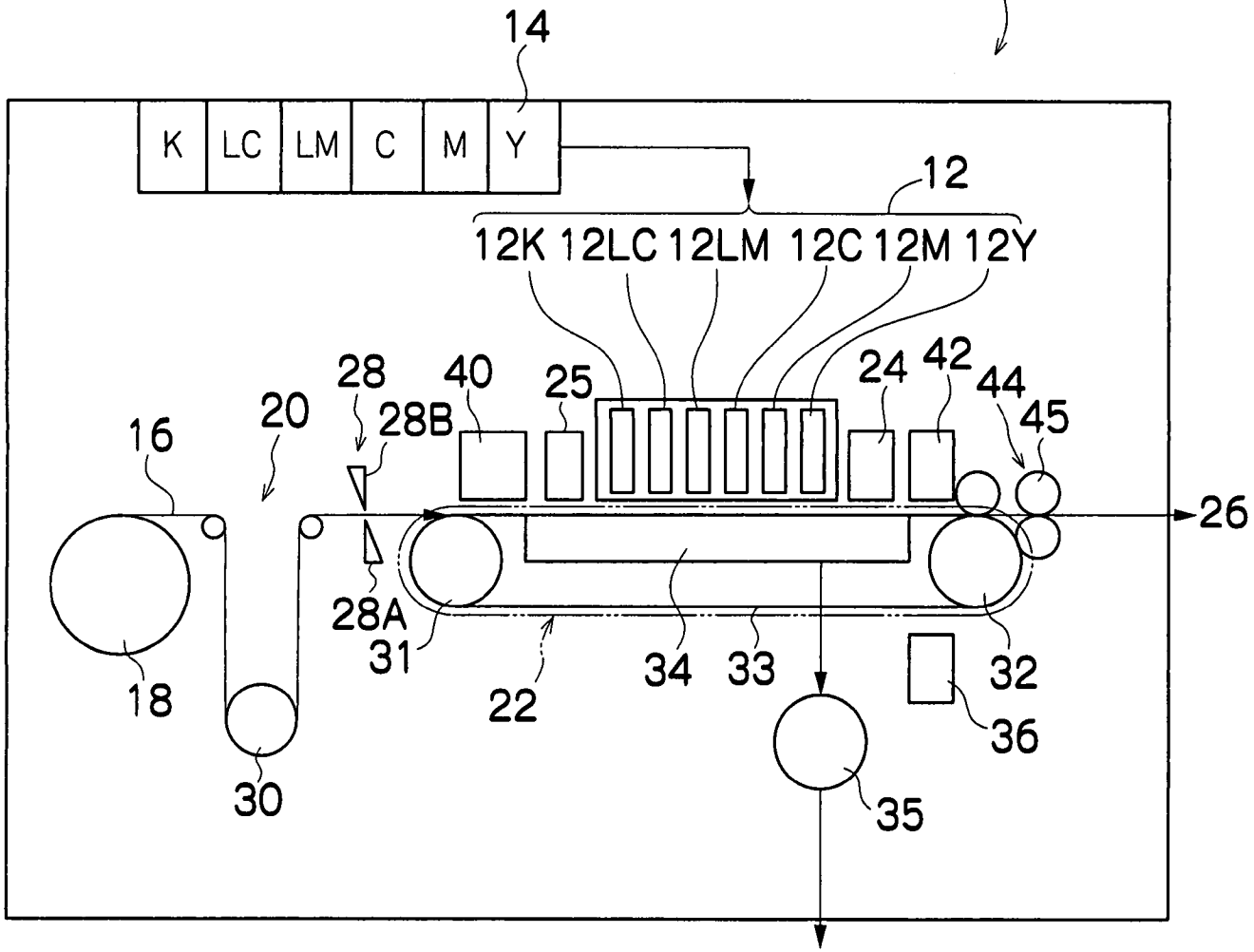
FIG. 1 is a general schematic drawing of an inkjet recording apparatus according to an embodiment of the present invention.

FIG. 1 is a general schematic drawing of an inkjet recording apparatus according to an embodiment of the present invention.

As shown in FIG. 1, the inkjet recording apparatus 10 comprises: a print head 12 having a plurality of printing units 12K, 12LC, 12LM, 12C, 12M, and 12Y for ink colors of black (K), light cyan (LC), light magenta (LM), cyan (C), magenta (M), and yellow (Y), respectively; an ink storing/loading unit 14 for storing inks to be supplied to the printing units 12K, 12LC, 12LM, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a discharge failure detection unit 24 for reading the printed result produced by the printing unit 12; a reference positioning sensor 25 for maintaining the picture in registration when forming the final printed image by returning the recording paper 16 to the printing position of the printing head 12 after the determination; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the discharge failure detection unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the discharge failure detection unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print head 12 comprises print units 12K, 12LC, 12LM, 12C, 12M and 12Y corresponding to inks of six colors (K (black), LC (light cyan), LM (light magenta), C (cyan), M (magenta) and Y (yellow)).

Figure 2:
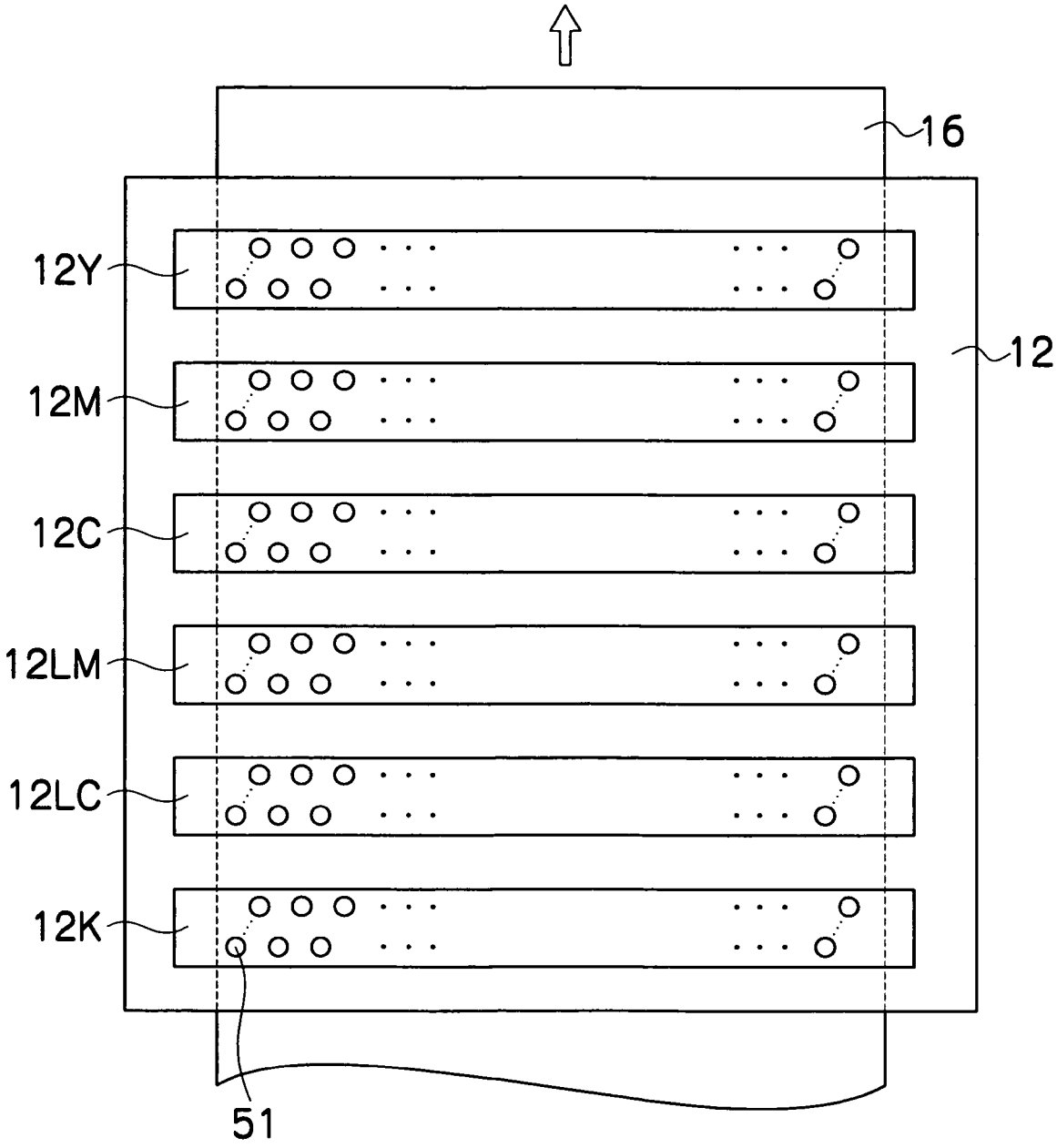
FIG. 2 is a plan perspective diagram showing the composition of a print head according to the present embodiment.

FIG. 2 shows a perspective plan diagram of the print head 12. In FIG. 2, the recording paper 16 is conveyed below the print head 12 in the direction of the arrow (the upward direction in FIG. 2). Each of the print units 12K, 12LC, 12LM, 12C, 12M and 12Y has a plurality of discharge ports (nozzles) 51 which discharge ink of the respective color. In FIG. 2 the nozzles 51 are depicted as being arranged on the surface of the diagram, but FIG. 2 is a perspective diagram, and the nozzles 51 are in fact arranged on the under side of the print head 12 in such a manner that they discharge ink toward the recording paper 16 conveyed under the print head 12 (in other words, in a rearward direction with respect to the plane of the drawing).

Furthermore, as shown in FIG. 2, the print head 12 is a so-called full-line head having a length corresponding to the maximum paper width, the respective print units 12K, 12LC, 12LM, 12C, 12M and 12Y being arranged such that their lengthwise direction coincides with the breadthways direction of the recording paper 16 (the main scanning direction) which is perpendicular to the paper conveyance direction (sub-scanning direction), in such a manner that they cover the full width of the recording paper 16, and a plurality of nozzles 51 being arranged in the lengthwise direction of the print units across a length exceeding at least the dimension of one edge of the maximum-size recording paper 16 that can be used with the inkjet recording apparatus 10.

The print head 12 is arranged in this order from the upstream side along the paper conveyance direction (as shown an arrow in FIG. 2). A color print can be formed on the recording paper 16 by ejecting the inks from the printing units 12K, 12LC, 12LM, 12C, 12M, and 12Y, respectively, onto the recording paper 16 while conveying the recording paper 16.

Though the configuration with the six colors adding two light inks of light cyan (LC) and light magenta (LM) to the KCMY four standard colors is described in the present embodiment, combinations of the ink colors and the number of colors are not limited to those. As required the other inks can be added, or configuration with the KCMY four standard colors is possible.

The print head 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the printing units 12K, 12LC, 12LM, 12C, 12M, and 12Y, and the tanks are connected to the printing units 12K, 12LC, 12LM, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The discharge failure detection unit 24 reads in the droplet ejection results of the print head 12 and detects discharge failures caused by blockages in the nozzles 51, and other discharge failure.

Figure 3:
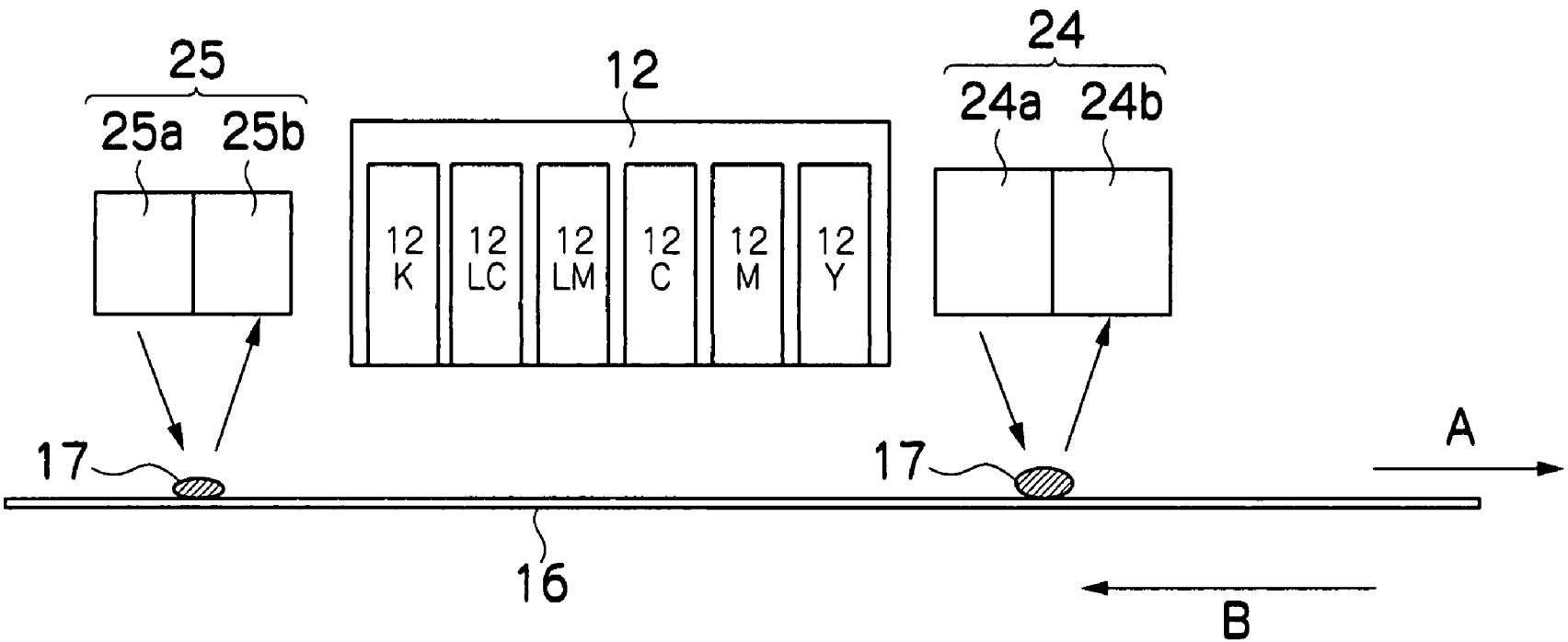
FIG. 3 is a side view showing the region of a discharge failure detection unit according to the present embodiment.

FIG. 3 shows an enlarged view of the region of the discharge failure detection unit 24. As shown in FIG. 3, the discharge failure detection unit 24 is disposed after the print head 12, and it comprises a light source 24*a* and a photoreceptor 24*b* (color sensor). The light source 24*a* is not limited in particular, and a light-emitting diode (LED), a laser diode (LD), a halogen lamp, a fluorescent tube, or the like, may be used. Furthermore, the photoreceptor 24*b* is not limited in particular, and a charge-coupled device (CCD), a phototransistor, or the like, may be used.

The photoreceptor 24*b* of the present embodiment is configured with at least a line sensor having rows of photoelectric transducing elements with a width that is greater than the ink-droplet ejection width (image recording width) of the printing units 12K, 12LC, 12LM, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

In discharge failure detection, when the ink dots 17 for discharge failure detection discharged onto the recording paper 16 from the print head 12 arrive directly below the discharge failure detection unit 24 due to the conveyance of the recording paper 16 in the direction of arrow A, light is irradiated onto the ink dots 17 from the light source 24*a*, this reflected light is evaluated by the photoreceptor 24*b*, and discharge failures or discharge errors are detected on the basis of the presence or absence of an ink dot 17 (the presence or absence of discharge), the dot deposition position, the dot size, the dot shape, or the like.

When the determination of discharge failure has been completed, the recording paper 16 is conveyed in a reverse direction as indicated by arrow B in FIG. 3 by means of the suction belt conveyance unit 22 (see FIG. 1), and the recording paper 16 is thus returned to the printing position of the print head 12. More specifically, the suction belt conveyance unit 22 also serves as a return conveyance device which returns the recording paper to the printing position of the print head after determination.

If a discharge failure has not been detected in the discharge failure detection described above, then the print head 12 forms the final output image by simply performing additional droplet ejection in accordance with the print data. On the other hand, if a discharge failure has been detected, then in addition to forming the final output image, rectification (compensation) is carried out with respect to the region where discharge failure has occurred. The method for selecting nozzles 51 which discharge ink dots 17 for discharge failure detection and the rectification method adopted if a discharge failure is detected are described in more detail below.

Furthermore, a reference positioning sensor 25 for determining a reference position is disposed in the vicinity of the print head 12 in such a manner that, when forming the final output image or when compensating for dots which have not been discharged by additional ejection of droplets after returning the recording paper 16 to the printing position of the print head 12, there is no positional displacement with respect to the previously discharged dots for discharge failure detection. There is no particular restriction on the composition of the reference positioning sensor 25, but it is possible to use a composition comprising a light source 25*a* and a photoreceptor 25*b*, similarly to the discharge failure detection unit 24.

A post-drying unit 42 is disposed following the discharge failure detection unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. Although not shown in the diagram, a sorter for collecting prints according to print orders is provided to the paper output unit 26 for the target prints.

Next, the structure of printing units 12K, 12LC, 12LM, 12C, 12M, and 12Y comprised in the print head 12 is described. Each of printing units 12K, 12LC, 12LM, 12C, 12M, and 12Y has the same structure, and includes a plurality of nozzles 51 two-dimensionally arranged in the form of a staggered matrix array as shown in FIG. 2.

Figure 4:
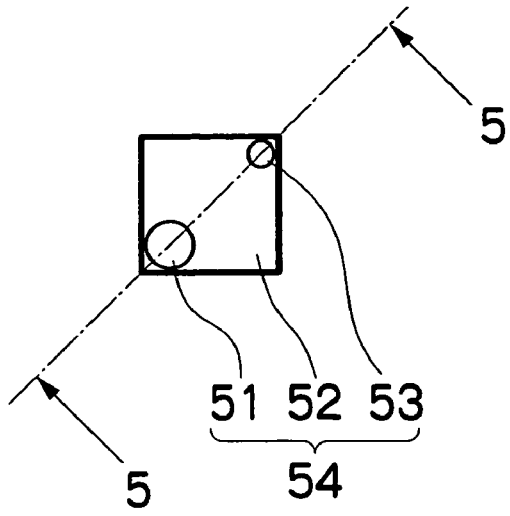
FIG. 4 is a plan diagram showing an enlarged view of a printing unit according to the present embodiment.

As shown in FIG. 4, a pressure chamber 52 connected to the nozzle 51 is provided corresponding to each nozzle 51, and an ink supply port 53 for supplying ink is formed in each pressure chamber 52. The nozzle 51 and the ink supply port 53 are respectively disposed at opposing corners on the diagonal of the pressure chamber 52. A pressure chamber unit 54 is formed by the pressure chamber 52, nozzle 51 and ink supply port 53, and the respective print units 12K, 12LC, 12LM, 12C, 12M and 12Y are formed by arranging a plurality of pressure chamber units 54 in a two-dimensional array.

Figure 5:
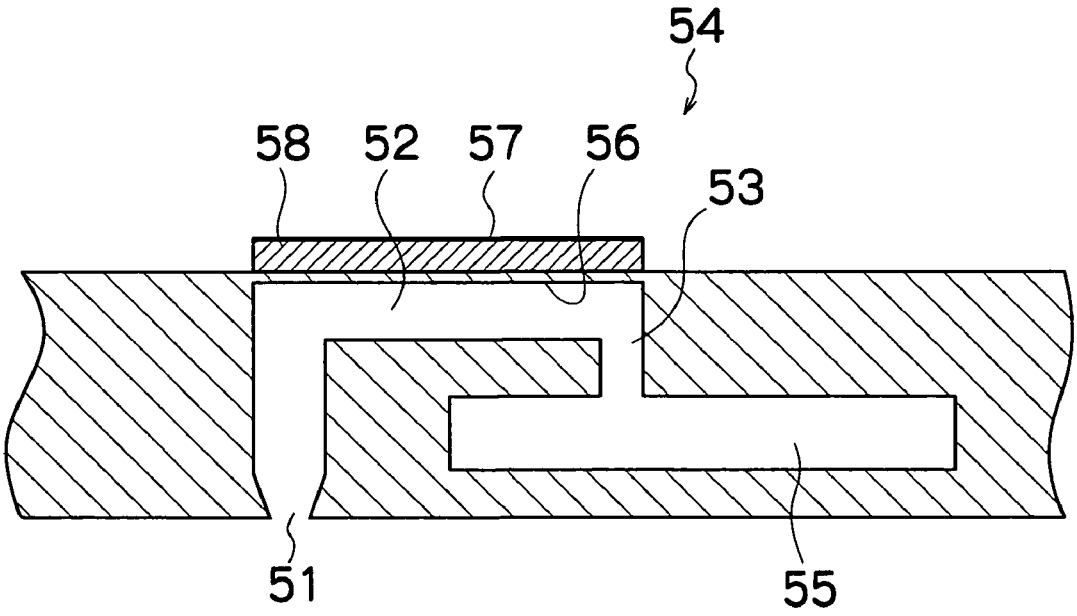
FIG. 5 is a cross-sectional diagram along line 5-5 in FIG. 4.

FIG. 5 is a cross-sectional view taken along the line 5-5 in FIG. 4, showing the inner structure of an ink chamber unit 54.

As shown in FIG. 5, an actuator 58 provided with an individual electrode 57 is bonded to a diaphragm 56, which forms the ceiling of the pressure chamber 52. Furthermore, the diaphragm 56 also serves as a common electrode. When a drive voltage is applied to the common electrode and the individual electrode 57, thereby applying an electrical field to the actuator 58, the actuator 58 is deformed, the diaphragm 56 is deformed toward the pressure chamber 52, and the volume of the pressure chamber 52 is reduced, thus causing the ink inside the pressure chamber 52 to be discharged from the nozzle 51.

On the other hand, the pressure chamber 52 is also connected to a common flow channel 55, via the ink supply port 53, and after discharge of the ink, the electrical field applied to the actuator 58 is released, and the actuator 58 and the diaphragm 56 return to their original states, thereby increasing the volume of the pressure chamber 52, in such a manner that new ink is supplied to the pressure chamber 52 from the common flow channel 55, via the ink supply port 53.

As described above, the direction of conveyance of the recording medium (the direction indicated by the arrow in FIG. 2, for example), is taken to be the sub-scanning direction, and the breadthways direction of the recording medium perpendicular to this (namely, the lengthwise direction of the printing unit) is taken to be the main scanning direction.

The concepts of main scanning and sub scanning used in the nozzle drive control method are described below.

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Figure 6:
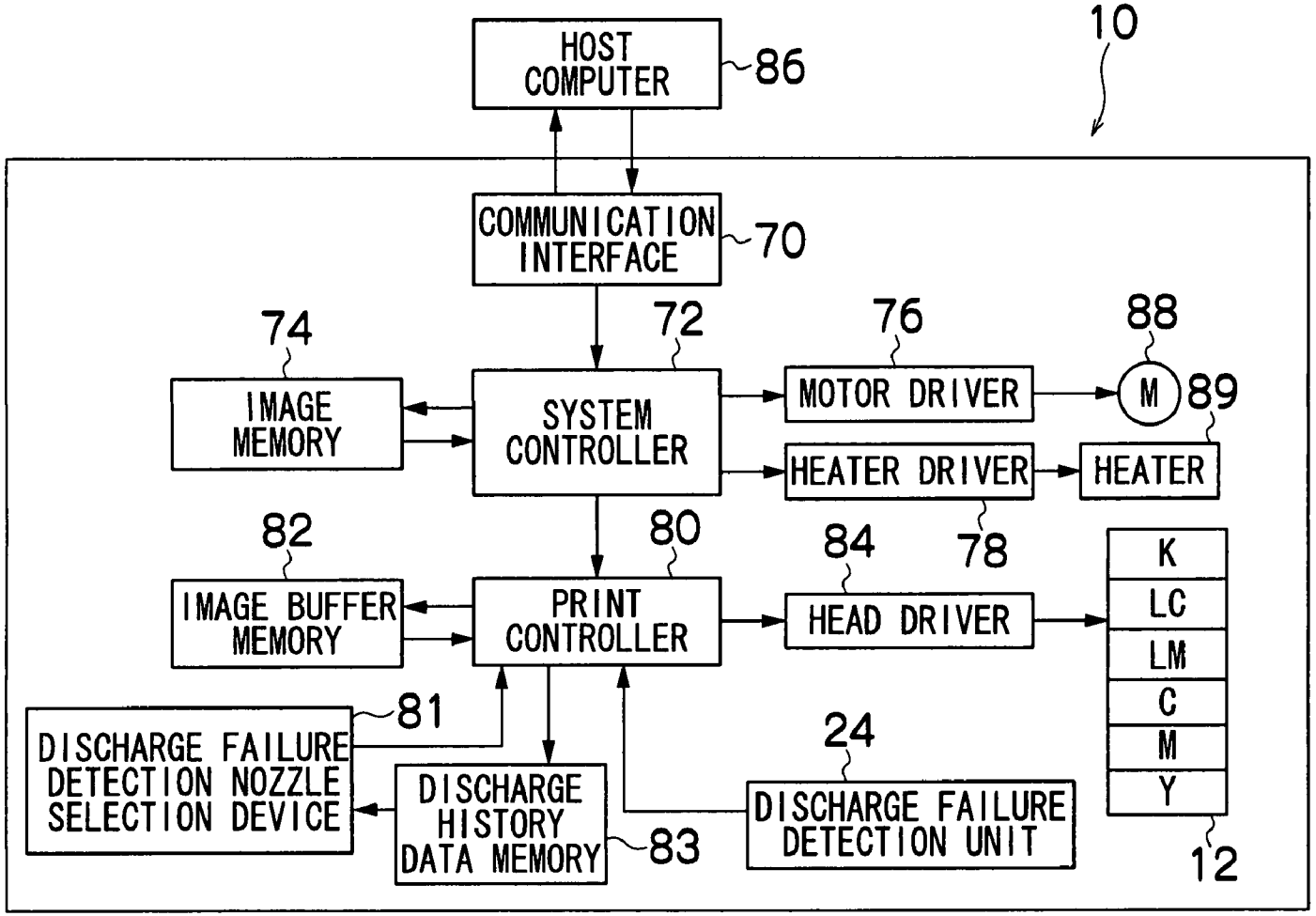
FIG. 6 is a block diagram showing the general composition of a control system for an inkjet recording apparatus according to the present embodiment.

FIG. 6 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefore, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (print data) thus generated to the head driver 84. Prescribed signal processing is carried out in the print control unit 80, and the discharge amount and the discharge timing of the ink droplets from the printing units 12K, 12LC, 12LM, 12C, 12M, and 12Y in the print head 12 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 59 for the printing units 12K, 12LC, 12LM, 12C, 12M, and 12Y in the print head 12 of the respective colors on the basis of the print data received from the print controller 80. A feedback control system for keeping the drive conditions for the print heads constant may be included in the head driver 84.

Furthermore, attached to the print controller 80, there are provided a selection device (discharge failure detection nozzle selection device) 81 which selects nozzles 51 for discharging ink dots for discharge failure detection, on the basis of the image data, prior to outputting the output image (the final output image), and a discharge history data memory 83 which stores history data for each nozzle. On the basis of the information from the selection device 81 and the discharge history data memory 83, the print controller 80 discharges ink dots for discharge failure detection from the print head 12 by supplying instructions to the head driver 84.

The selection of the ink dots used for discharge failure detection (or, in other words, the nozzles 51 discharging those ink dots) is made as described below.

Figure 7:
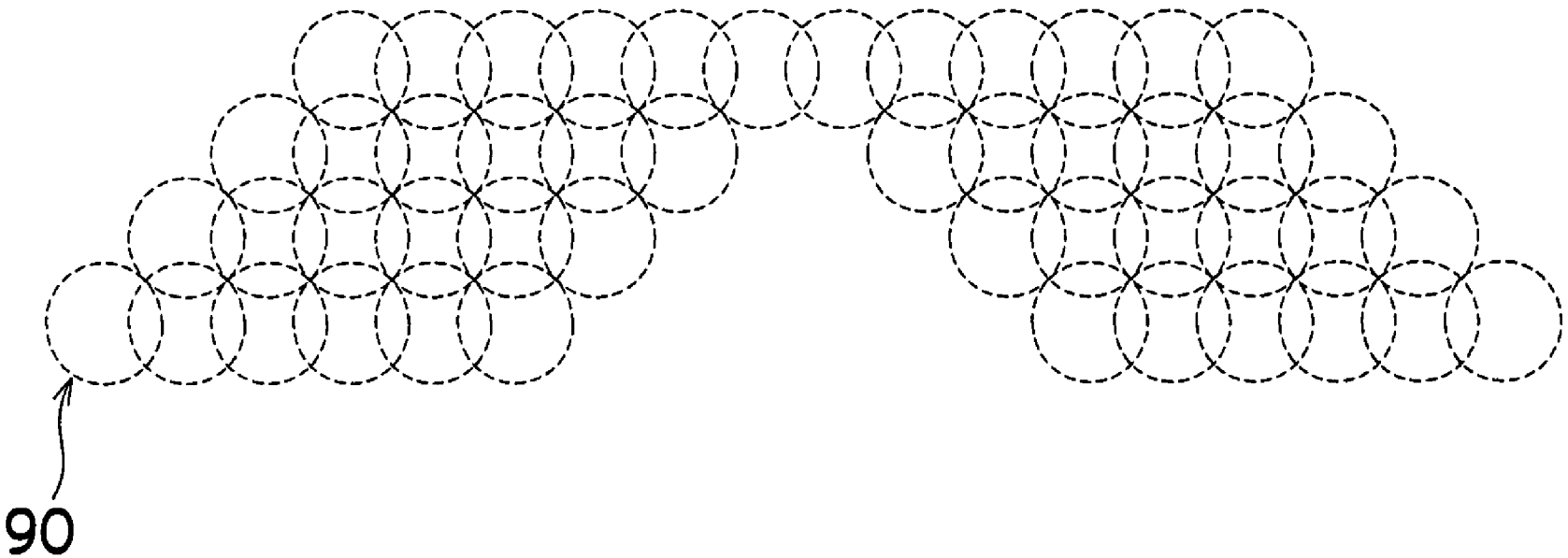
FIG. 7 is a plan diagram showing a schematic view of recording dots based on output print data according to the present embodiment.

FIG. 7 shows an example of a recording image that is to be formed on the recording paper 16 in accordance with the output print data. The example in FIG. 7 comprises two symmetrical diamond-shaped regions in which a plurality of circular dots 90 indicated by broken lines are arranged in a dense configuration.

The dots used for discharge failure detection are selected from amongst this plurality of dots 90 based on the print data, but firstly, it is necessary to separate the dots for discharge failure detection so that they do not overlap with other dots, in such a manner that the dots for discharge failure detection discharged onto the recording paper 16 can be determined accurately by the reading sensor (photoreceptor 24*b*). Therefore, the dots for discharge failure detection are selected in such a manner that the interval between these dots on the recording paper 16 is at least ½ of the minimum diameter of the dots formed on the recording paper 16 by the print head 12 (in other words, an interval of 0.5 dot or more).

Figure 8:
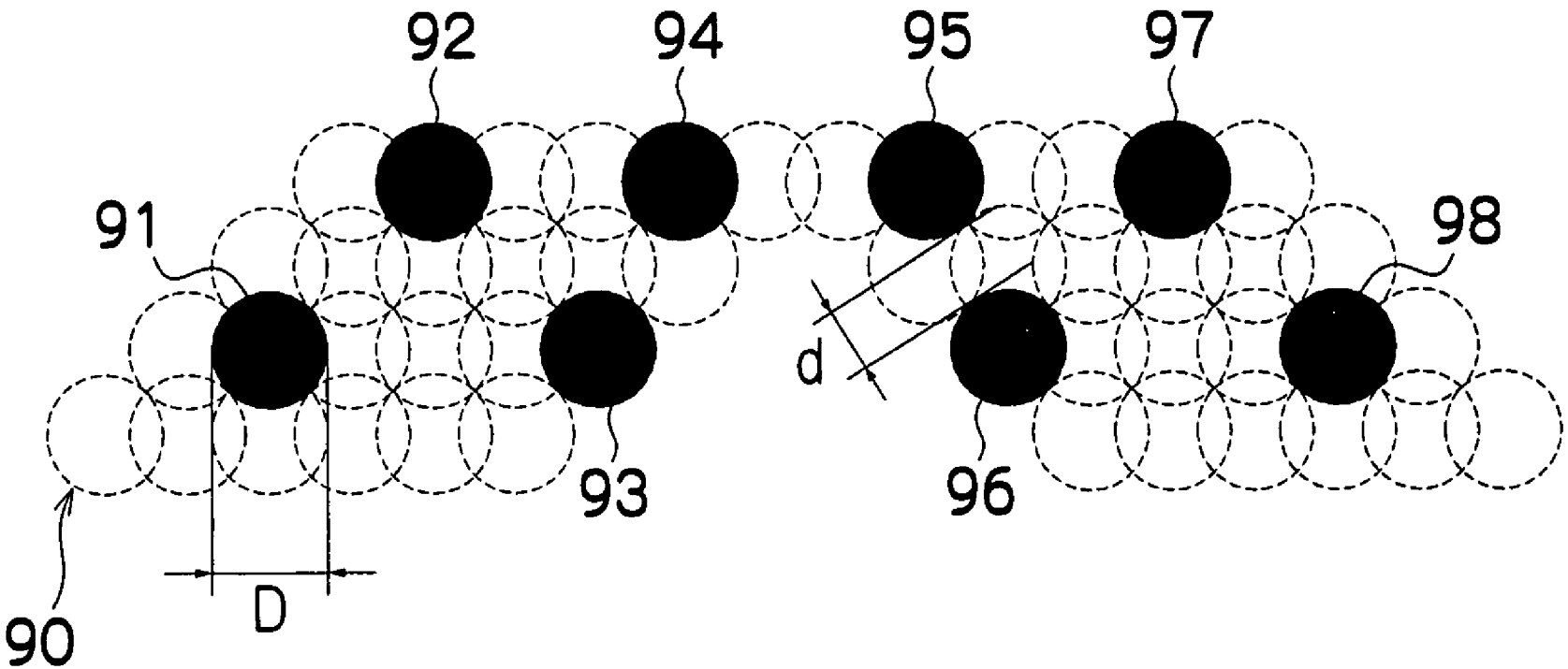
FIG. 8 is an illustrative diagram showing a situation where dots for discharge failure detection are selected from the output print data illustrated in FIG. 7.

FIG. 8 shows a state where eight dots 91 to 98 for discharge failure detection are selected from the dots 90 to be outputted in accordance with the print data, in such a manner that an interval of at least ½ the minimum dot diameter is left between the respective dots. In other words, as shown in FIG. 8, if the minimum dot diameter of the respective dots 90 is taken to be D, then the dots 91 to 98 for discharge failure detection are selected in such a manner that the interval between dots, d, is equal to or greater than ½ of the minimum dot diameter D (i.e., $d>D/2$). In the present embodiment, the ink droplet volume is taken to be 2 pl, and the resulting dot size is taken to be approximately 25 μm to 30 μm.

Next, desirably, the dots for discharge failure detection are selected from a region where the output print data is of low visibility. Alternatively, it is desirable that the dots for discharge failure detection are selected from dots in the vicinity of the front end section or trailing end section of the recording image on the recording paper 16 when the image is output. This is because the dots will not be readily discernible, even if the position of the recording paper 16 is displaced when it is subsequently returned to the recording position after determination and additional droplets are ejected (namely, overwriting is performed).

Figure 9:
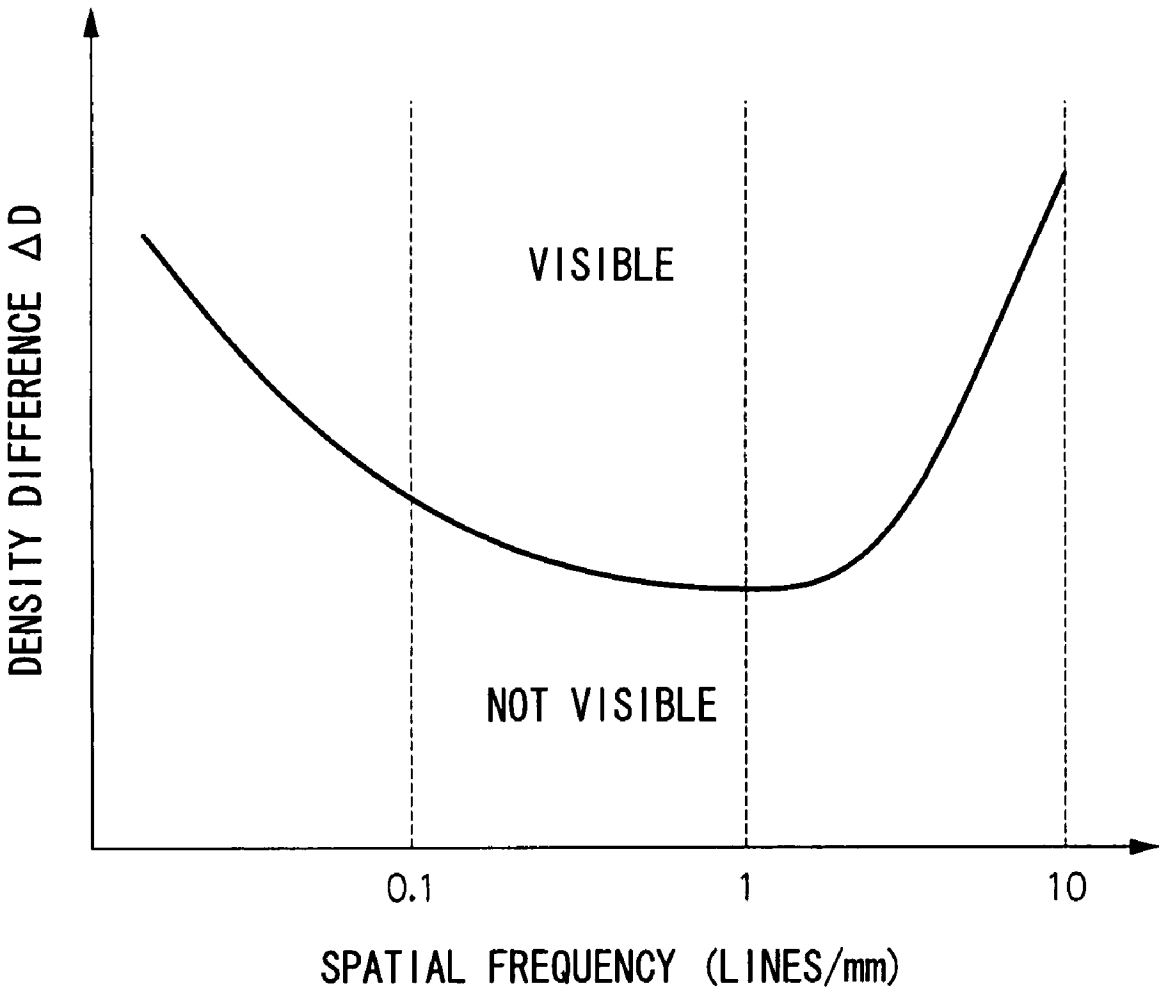
FIG. 9 is a graph showing the relationship between difference in density and spatial frequency.

If the dots for discharge failure detection are to be selected from a region of low visibility, then it can be imagined that the dots should be chosen from a region where the difference in density is not readily visible, since the human eye has a greater capacity to perceive variation in density than variation in color. In general, the relationship between spatial frequency and the difference in density ΔD that can be perceived by the human eye is as shown by the graph in the FIG. 9. As shown in FIG. 9, the visible difference in density is a minimum when the spatial frequency is 1 lines/mm to 1.5 lines/mm, and if the spatial frequency is increased beyond this, or if it is reduced below this, then the visible difference in density becomes larger. In other words, if the spatial frequency is higher or lower than 1 lines/mm to 1.5 lines/mm, then the difference in density becomes more difficult to perceive.

Consequently, the difference in density is readily visible in a spatial frequency range of 1 lines/mm to 1.5 lines/mm, and the region of spatial frequency outside this range is a region of low visibility. Therefore, dots for discharge failure detection are selected from a part of the image lying in this region of low visibility.

In other words, desirably, the dots for discharge failure detection are selected from an image region having a spatial frequency of 0.5 lines/mm or less, in other words, a line pitch of 2 mm or above, or a spatial frequency of 2 lines/mm or above, in other words, a line pitch of 0.25 mm or less. Here, the spatial frequency indicates the spatial frequency of the output image or pattern (the change in color density, or the change in the pattern), or the interval between dots.

Furthermore, it is also possible to store history data, such as the past discharge failure detection data, or the elapsed time since the previous discharge, for each nozzle 51, in a discharge history data memory 83, and to select the nozzles 51 which discharge the dots for discharge failure detection, by means of the discharge failure detection nozzle selection device 81, on the basis of this data. Thereby, it is possible to reduce ink consumption by focusing the discharge determination on nozzles which have a high probability of suffering discharge failure.

Figure 10:
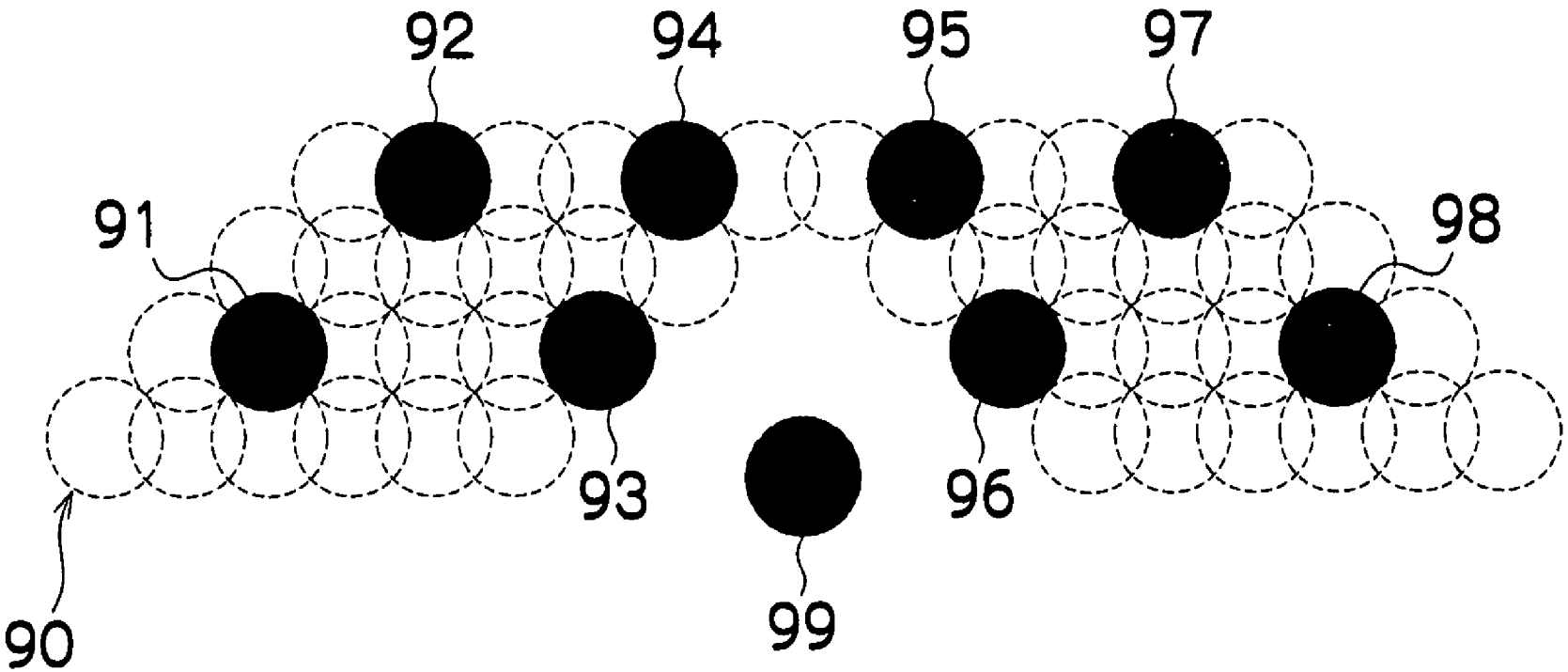
FIG. 10 is an illustrative diagram showing a further method for selecting dots for discharge failure detection.

Moreover, as stated previously, rather than selecting the dots for discharge failure detection from the output print data, it is possible to select nozzles 51 other than the nozzles which discharge print data, in such a manner that a dot 99 for discharge failure detection is discharged outside the range of the output image, as illustrated in FIG. 10, for example.

However, in this case, the dot 99 for discharge failure detection is selected from a region of low visibility on the recording paper 16, with respect to the output image. Similarly to the previous description, here, a region of low visibility is a region having a spatial frequency of 0.5 lines/mm or less, in other words, a line pitch of 2 mm or above, or a spatial frequency of 2 lines/mm or above, in other words, a line pitch of 0.25 mm or less, which is separated from the end of the output image. Furthermore, if a plurality of dots for discharge failure detection are deposited, then the aforementioned interval should be left between these dots, in a similar manner. In this case, similarly to the foregoing, the minimum interval between dots is at least ½ the dot size.

As described above, dots for discharge failure detection are selected, ink is discharged onto the recording paper 16 from the print head 12, and a pattern for discharge failure detection is formed as indicated by the black circles in FIG. 8 and FIG. 10.

After discharging the dots for discharge failure detection, the recording paper 16 is conveyed to a position below the discharge failure detection unit 24, and the dots for discharge failure detection are determined by the discharge failure detection unit 24.

After determination, the suction belt conveyance unit 22 is driven in the reverse direction, the recording paper 16 is returned to the recording position of the print head 12, and additional droplets are ejected in accordance with the output print data. The operation of returning the recording paper 16 to the print position of the print head 12 is not limited to a switch back method which drives the suction belt conveyance unit 22 in reverse and thus reverses the sub-scanning direction, and it may also be a loop method which conveys the recording paper 16 further forward in the sub-scanning direction, such that it performs a cycle and returns again to the print position.

Figure 11:
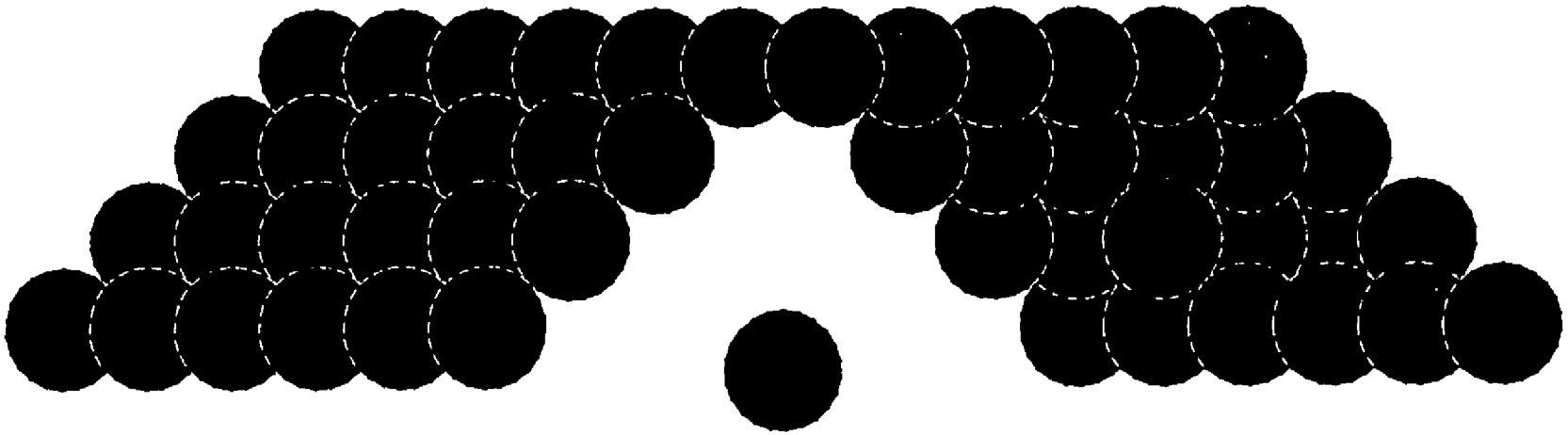
FIG. 11 is an illustrative diagram showing a situation where additional droplets corresponding to print data are ejected onto the dots for discharge failure detection shown in FIG. 10.

In this case, the additional droplet ejection is performed by ejecting droplets to form dots on the basis of the remaining print data, between the dots for discharge failure detection which have been determined. For example, if the dots for discharge failure detection are as illustrated in FIG. 10, then when additional droplets are ejected to form the dots based on the print data, in addition to the dots 91 to 99 deposited in FIG. 10, an image such as that illustrated in FIG. 11 is formed. Here, the dot 99 for discharge failure detection which is separated from the output image is of low visibility, as described above, and hence it has virtually no effect on the output image.

The method for ejecting additional droplets is not limited to a method in which the droplets are ejected to form the additional dots on the basis of the print data, between the dots for discharge failure detection that have been determined, and another method for ejecting the additional droplets may be adopted.

Figure 12:
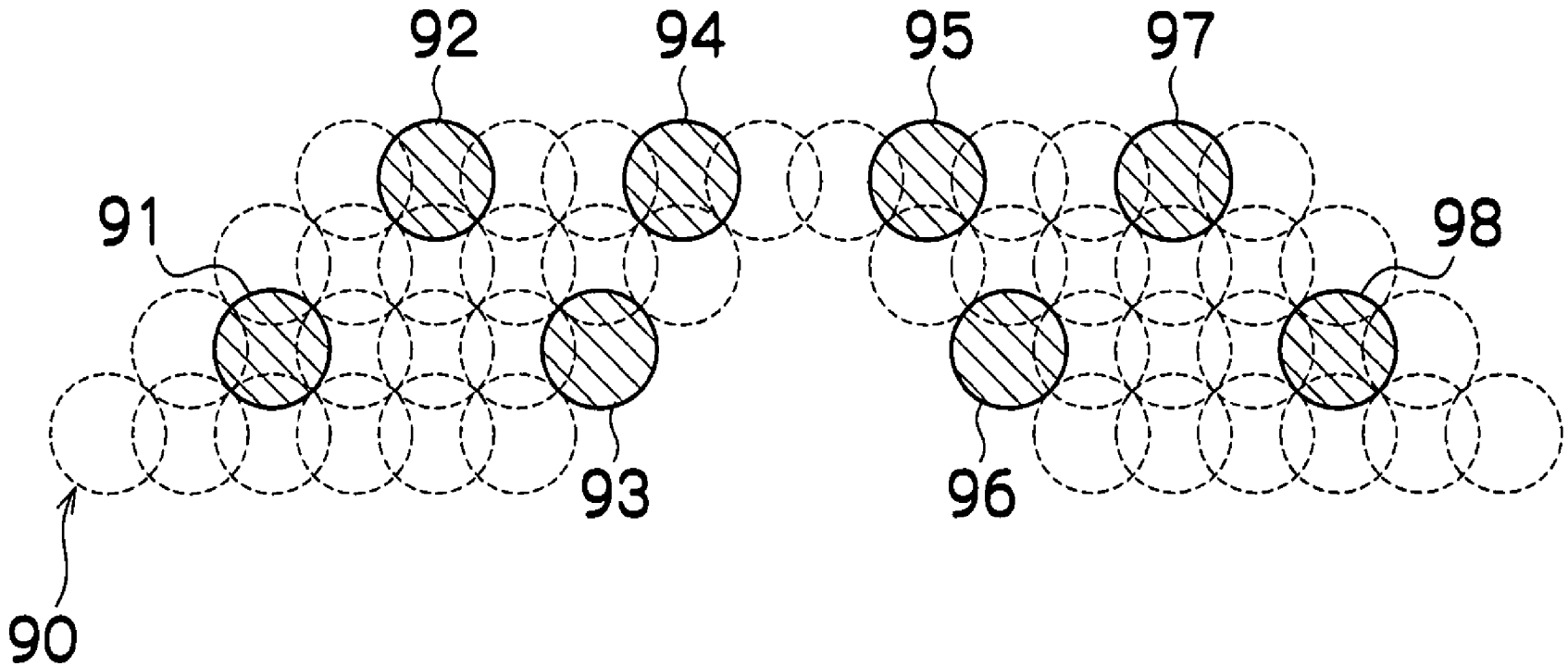
FIG. 12 is an illustrative diagram showing a further example of dots for discharge failure detection.
Figure 13:
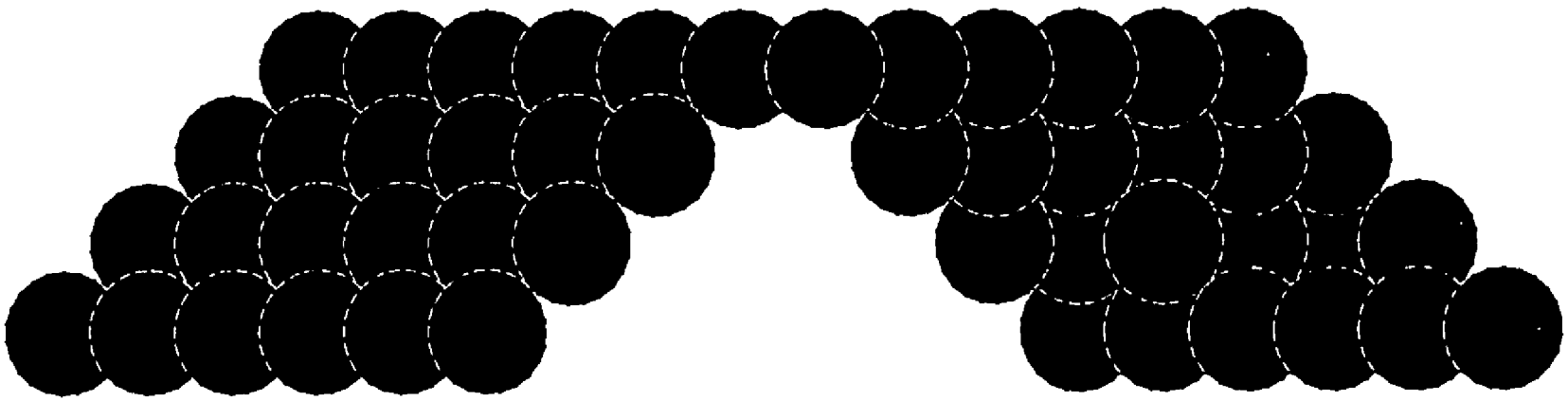
FIG. 13 is an illustrative diagram showing a state where print data is recorded onto the dots for discharge failure detection shown in FIG. 12.

For example, as shown in FIG. 12, the dots 90 to 98 for discharge failure detection may be deposited firstly using an ink of a color having a light density, and when the additional droplets are ejected subsequently after determination, ink of a color having a darker density than the dots for discharge failure detection is superimposed thereon, thus resulting in the output image illustrated in FIG. 13.

Furthermore, it is also possible to eject and superimpose additional droplets of a different color ink to the ink color of the dots for discharge failure detection, in such a manner that the desired color to be output is obtained ultimately from the mixture of these inks of different colors. For example, if green (G) is the ultimately desired color, then it is possible to print the dot for discharge failure detection with yellow (Y) ink, and then superimpose a droplet of cyan (C) ink over this during the ejection of additional droplets, or vice versa. Alternatively, if black (K) is the ultimately desired color, then it is possible to print the dot for discharge failure detection with cyan (C) ink, and then superimpose droplets of magenta (M) ink and yellow (Y) ink over this during the ejection of additional droplets, thus obtaining a black (K) dot.

Furthermore, in the present embodiment, dots for discharge failure detection (a pattern for discharge failure detection) are printed by the print head 12, as described above, and the recording paper 16 is then conveyed to the discharge failure detection unit 24, where the dots for discharge failure detection are determined, whereupon the recording paper 16 is then conveyed back in reverse in the sub-scanning direction to the print head 12, and additional droplets are ejected by the print head 12 in a superimposed fashion onto the dots for discharge failure detection. Therefore, it is necessary to ensure that there is no positional displacement between the dots for discharge failure detection and the dots based on the print data which are subsequently formed by the additionally ejected droplets. This is particularly important when the dots for discharge failure detection have been selected from the output print data.

Therefore, when the dots for discharge failure detection are selected by the discharge failure detection nozzle selection device 81 attached to the print controller, a reference dot forming a positioning reference is specified, and when the final output image is formed by additional droplet ejection, the image formation position is aligned by detecting this reference dot by means of the reference position sensor 25, thus making it possible to obtain a final output image of high quality which does not contain any positional error. The selection of the reference dot forming the positioning reference is not limited in particular, and any of the dots for discharge failure detection may be selected as the reference dot. However, desirably, the dot should have a clearly defined position and for the sake of convenience during recording, a dot in the front end portion of the image should be used as the reference dot.

Moreover, in discharge failure detection by the discharge failure detection unit 24, if a discharge failure or other discharge error is detected, then when writing the normal image by ejection of additional droplets after determination, the image is compensated by means of a nozzle 51 which deposits a dot adjacent to the dot subject to the discharge error.

When a discharge error has occurred and printing is not possible from the nozzle 51 suffering this discharge error, then a compensation operation is carried out using nozzles 51 adjacent to the nozzle 51 suffering the discharge error, for example.

Figure 14:
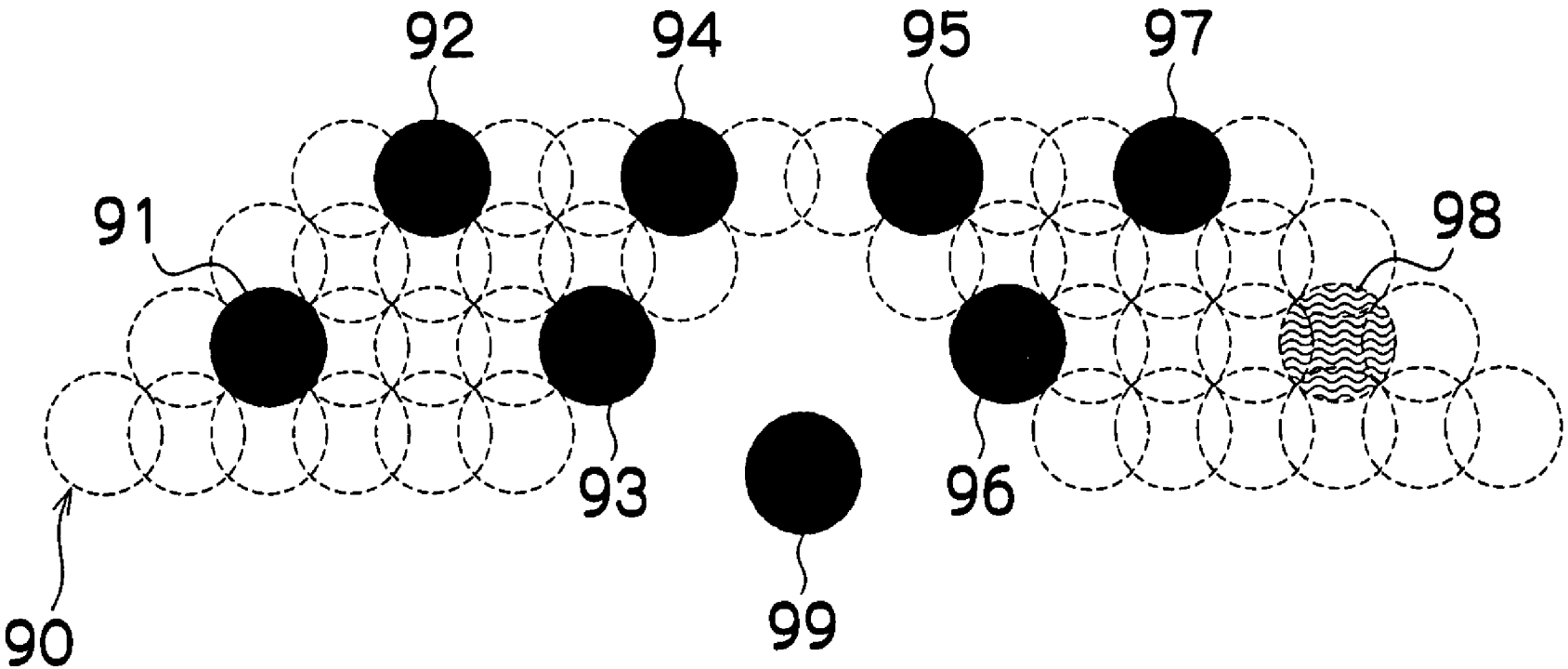
FIG. 14 is an illustrative diagram showing a situation where a nozzle suffering a discharge failure is detected.

For instance, in FIG. 14, it is supposed that the dot for discharge failure detection 98 is subject to a discharge error. In this case, in addition to returning the recording paper 16 to the recording position of the print head 12, the print controller 80 confirms the position of the dot 98 relating to the discharge error, and controls the head driver 84 in such a manner that the amount of ink discharged from the nozzles 51 which eject droplets to form dots adjacent to dot 98 is increased.

Figure 15:
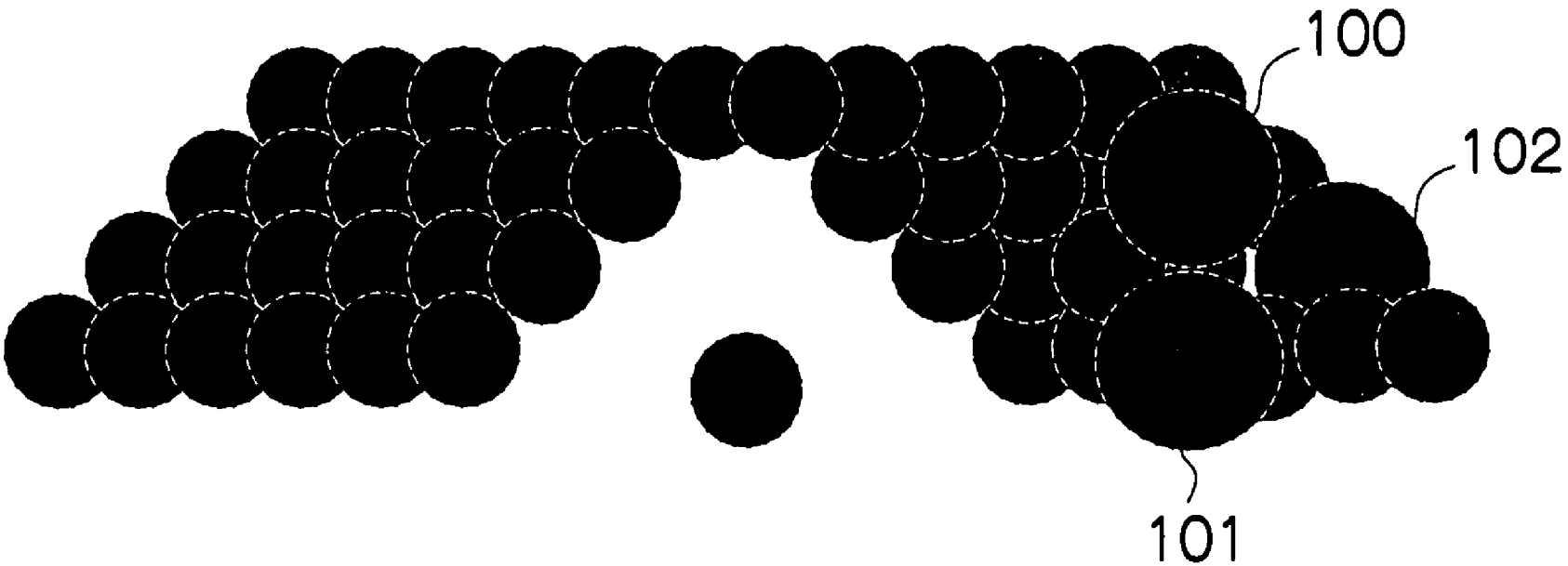

As shown in FIG. 15, the dots 100, 101 and 102 surrounding the dot for discharge failure detection 98 which is suffering a discharge error are increased in size, thereby compensating for the dot 98.

The method for compensating for a dot which has failed to be discharged is not limited to this method, and other compensation methods may be employed. For example, it is also possible to compensate by moving the print head 12 and printing a dot with a different nozzle 51 of the same color. Depending on the circumstances, it is also possible to compensate by using a nozzle 51 of a different color.

As described above, according to the present embodiment, since a prescribed interval or more is left between dots on the recording paper which are used for detecting discharge failure, then it is possible to determine discharge with a high degree of accuracy. Furthermore, after printing dots for discharge failure detection (or a pattern for discharge failure detection) on the recording paper and carrying out a determination operation, the recording paper is returned to the recording position of the print hand, and normal printing is carried out in a superimposed fashion on the dots for discharge failure detection. Therefore, is not necessary to provide a special recording medium for determination purposes, and there is no wasteful consumption of the recording medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a full line print head in which a plurality of nozzles are arranged for respective ink colors across a length corresponding to a full width of a recording medium;

a selection device which selects at least one of the plurality of nozzles for printing a dot onto the recording medium as a dot for a discharge failure detection, from at least one of the plurality of nozzles to be used for a print for obtaining a final output image based on print data;

a discharge failure detection device which performs the discharge failure detection by reading in the dot for the discharge failure detection printed on the recording medium; and a reverse conveyance device which returns the recording medium to a printing position of the print head after the discharge failure detection performed by the discharge failure detection device, wherein the print for obtaining the final output image is performed by the print head onto the recording medium, by returning the recording medium to the printing position of the print head by the reverse conveyance device after the discharge failure detection performed by the discharge failure detection device.

2. The image forming apparatus as defined in claim 1, wherein an interval between dots for the discharge failure detection on the recording medium is not less than one half of a minimum diameter of dot printed by the print head.

3. The inkjet recording apparatus as defined in claim 1, wherein the selection device selects the dot for the discharge failure detection from a region of the final output image that has a spatial frequency that is outside a range of 1 lines/mm to 1.5 lines/mm.

4. The inkjet recording apparatus as defined in claim 3, wherein the selection device selects the dot for the discharge failure detection from a region of the final output image that has a spatial frequency that is one of not greater than 0.5 lines/mm and not less than 2 lines/mm.

5. The inkjet recording apparatus as defined in claim 1, wherein the selection device selects the dot for the discharge failure detection from one of a front end section and a trailing end section of the final output image on the recording medium.

6. The inkjet recording apparatus as defined in claim 1, wherein the selection device selects the at least one of the plurality of nozzles for printing the dot for the discharge failure detection onto the recording medium, according to history data for each of the plurality of nozzles.

7. The inkjet recording apparatus as defined in claim 1, wherein:

when the selection device selects at least two of the plurality of nozzles for printing dots for the discharge failure detection onto the recording medium, the selection device specifies one of the dots for the discharge failure detection as a reference dot for positioning;

the inkjet recording apparatus further comprises a reference positioning sensor which detects the reference dot, the reference positioning sensor being arranged in a vicinity of the print head; and the print for obtaining the final output image is performed by taking a position of the reference dot detected by the reference positioning sensor as a reference position.

8. The inkjet recording apparatus as defined in claim 1, wherein if a discharge failure is detected by the discharge failure detection device, then a compensation operation is performed with respect to the dot subject to the discharge failure, by means of adjacent nozzles to the nozzle for which the discharge failure has been detected.

9. An inkjet recording apparatus comprising:

a full line print head in which a plurality of nozzles are arranged for respective ink colors across a length corresponding to a full width of a recording medium;

a selection device which selects at least one of the plurality of nozzles for printing a dot onto the recording medium for a discharge failure detection, from at least one of the plurality of nozzles to be not used for a print for obtaining a final output image based on print data;

a discharge failure detection device which performs the discharge failure detection by reading in the dot for the discharge failure detection printed on the recording medium; and a reverse conveyance device which returns the recording medium to a printing position of the print head after the discharge failure detection performed by the discharge failure detection device, wherein the dot for the discharge failure detection is printed outside a region of the final output image, and the print for obtaining the final output image is performed by the print head onto the recording medium, by returning the recording medium to the printing position of the print head by the reverse conveyance device after the discharge failure detection performed by the discharge failure detection device.

10. The inkjet recording apparatus as defined in claim 9, wherein if a discharge failure is detected by the discharge failure detection device, then a compensation operation is performed with respect to the dot subject to the discharge failure, by means of adjacent nozzles to the nozzle for which the discharge failure has been detected.

* * * * *